US006725924B2

(12) United States Patent
Davidson et al.

(10) Patent No.: US 6,725,924 B2
(45) Date of Patent: Apr. 27, 2004

(54) SYSTEM AND TECHNIQUE FOR MONITORING AND MANAGING THE DEPLOYMENT OF SUBSEA EQUIPMENT

(75) Inventors: Kenneth C. Davidson, Sugar Land, TX (US); John A. Kerr, Sugar Land, TX (US); Roderick MacKenzie, Sugar Land, TX (US); Alan J. Johnston, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/170,520

(22) Filed: Jun. 13, 2002

(65) Prior Publication Data

US 2002/0189806 A1 Dec. 19, 2002

Related U.S. Application Data

(60) Provisional application No. 60/298,714, filed on Jun. 15, 2001.

(51) Int. Cl.[7] ..... E21B 41/04; E21B 47/00

(52) U.S. Cl. ..... 166/250.01; 166/338; 166/336; 166/335

(58) Field of Search ..... 166/335, 338, 166/339, 350, 352, 363, 66, 250.01, 255.2, 336, 367

(56) References Cited

U.S. PATENT DOCUMENTS

| | | | | |
|---|---|---|---|---|
| 4,031,544 A | | 6/1977 | Lapetina | |
| 4,167,215 A | * | 9/1979 | Thorne | 166/341 |
| 4,643,616 A | * | 2/1987 | Castel et al. | 166/338 |
| 4,830,541 A | | 5/1989 | Shatto | |
| 4,862,426 A | * | 8/1989 | Cassity et al. | 166/335 |
| 5,249,891 A | | 10/1993 | Pecue, II | |
| 5,269,383 A | | 12/1993 | Forrest | 175/26 |
| 5,484,029 A | | 1/1996 | Eddison | 175/73 |
| 5,829,520 A | | 11/1998 | Johnson | |
| 6,092,598 A | | 7/2000 | Breit | |
| 6,142,228 A | | 11/2000 | Jogi et al. | |
| 6,170,573 B1 | | 1/2001 | Brunet et al. | |
| 6,216,533 B1 | | 4/2001 | Woloson et al. | |
| 6,276,466 B1 | | 8/2001 | Boyd | |
| 6,293,344 B1 | | 9/2001 | Nixon et al. | 166/363 |
| 6,302,203 B1 | | 10/2001 | Rayssiguier et al. | |
| 6,364,021 B1 | * | 4/2002 | Coats | 166/367 |
| 6,478,087 B2 | * | 11/2002 | Allen | 166/255.1 |
| 2001/0042617 A1 | | 11/2001 | Beck et al. | |
| 2002/0000317 A1 | | 1/2002 | Rayssiguier et al. | |
| 2002/0007948 A1 | | 1/2002 | Bayne et al. | |

FOREIGN PATENT DOCUMENTS

| | | | |
|---|---|---|---|
| GB | 1268064 | 3/1972 | |
| GB | 1 268 064 | 3/1972 | E21B/33/035 |
| GB | 2099881 | 12/1982 | |
| GB | 2236341 | 4/1991 | |
| GB | 2 247 477 A | 3/1992 | E21B/47/12 |
| GB | 2 351 303 A | 12/2000 | E21B/23/00 |

* cited by examiner

*Primary Examiner*—David Bagnell
*Assistant Examiner*—Thomas Bomar
(74) *Attorney, Agent, or Firm*—Trop, Pruner & Nu PC; Jeffrey Griffin; Brigitte Jeffery Echols

(57) ABSTRACT

A system that is usable in a subsea well includes a tubular string that extends from a surface platform toward the sea floor. The string has an upper end and a lower remote end that is located closer to the sea floor than to the platform. At least one sensor of the system is located near the remote end of the string to monitor deployment of subsea equipment.

83 Claims, 9 Drawing Sheets

SYSTEM AND TECHNIQUE FOR MONITORING AND MANAGING THE DEPLOYMENT OF SUBSEA EQUIPMENT

This application claims the benefit, pursuant to 35 U.S.C. §119, to U.S. patent application Ser. No. 60/298,714, filed on Jun. 15, 2001.

BACKGROUND

The invention generally relates to a system and technique for monitoring and managing the deployment of subsea equipment, such as subsea completion equipment and tubing hanging systems, for example.

A production tubing may be used in a subsea well for purposes of communicating produced well fluids from subterranean formations of the well to equipment at the sea floor. The top end of the production tubing may be threaded into a tubing hanger that, in turn, is seated in a well tree for purposes of suspending the production tubing inside the well.

For purposes of completing a subsea well and installing the production tubing, the production tubing typically is lowered into a marine riser string that extends from a surface platform (a surface vessel, for example) down to the subsea equipment (a well tree, blowout preventer (BOP), etc.) that defines the sea floor entry point of the well. The marine riser string forms protection for the production tubing and other equipment (described below) that is lowered into the subsea well from the platform. At the sea surface, the top end of the production tubing is connected to (threaded to, for example) a tubing hanger that follows the production tubing down through the marine riser string. A tubing hanger running tool is connected between the tubing hanger and a landing string, and the landing string is lowered down the marine riser string to position the tubing hanger running tool, tubing hanger and production tubing in the well so that the tubing hanger lands in, or becomes seated in, the subsea well head.

The tubing hanger running tool is hydraulically or mechanically activated to set the tubing hanger in the well tree. When set, the tubing hanger becomes locked to the well tree. After setting the tubing hanger, the tubing hanger running tool may be remotely unlatched from the tubing hanger and retrieved with the landing string from the platform.

The control and monitoring of the deployment of the tubing hanger and landing string may present challenges. As an example, for a hydraulically set tubing hanger, operations to set the tubing hanger typically are monitored from the platform via readouts of various hydraulic volumes and pressures. However, a disadvantage with this technique to set the tubing hanger is that the interpretation of these readouts is based on inferences made from similar readouts that were obtained from previous successful operations.

As another example of potential challenges, the landing of the tubing hanger in the well tree typically is monitored by observing forces that are exerted on the landing string near the surface platform. In this manner, when the tubing hanger lands in position in the well tree, the absence of the weight of the production tubing on the landing string should be detected at the surface platform. However, the landing string typically is subject to significant frictional forces that cause surface readings of these forces to vary substantially from the actual forces that are exerted on the string near the subsea well head, thereby making the surface readings unreliable.

Other aspects related to the positioning of the tools on the end of the landing string are likewise different to monitor from readouts obtained near the platform.

Thus, there is a continuing need for a better technique and/or system to monitor and manage the deployment of subsea completion equipment and tubing hanger systems.

SUMMARY

In an embodiment of the invention, a system that is usable with a subsea well includes a tubular string that extends from a surface platform toward the sea floor. The string has an upper end and a lower remote end. At least one sensor of the system is located near the remote end of the string to monitor deployment of subsea equipment.

Advantages and other features of the invention will become apparent from the following detailed description and claims.

DETAILED DESCRIPTION

Figure 1:
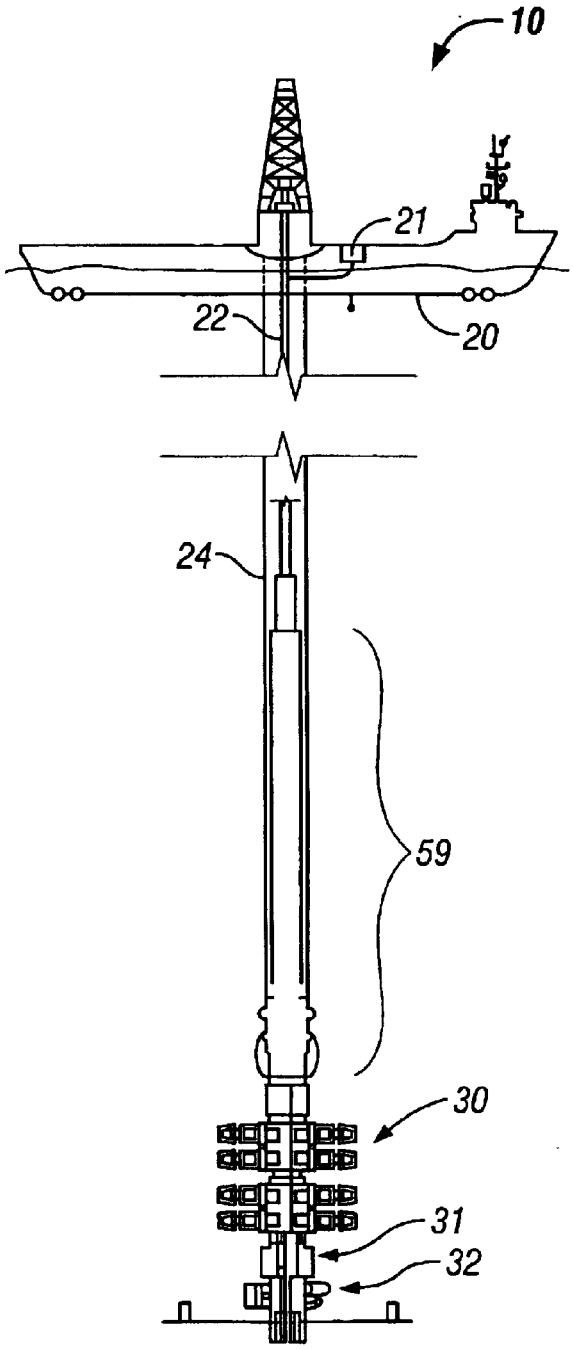
FIG. 1 is a schematic diagram of a subsea well system according to an embodiment of the invention.

Referring to FIG. 1, a subsea well system 10 in accordance with the invention includes a sea surface platform 20

(a surface vessel (as shown) or a fixed platform, as examples) that includes circuitry 21 (a computer and telemetry circuitry, for example) for communicating with subsea circuitry (described below) for purposes of monitoring and managing the deployment of completion equipment into a subsea well. In this manner, in some embodiments of the invention, the circuitry 21 may be used to communicate with landing string circuitry that is positioned near the lower, remote end of a landing string 22 for purposes of monitoring and managing the deployment of a tubing hanger and production tubing inside the subsea well.

More specifically, in some embodiments of the invention, the system 10 includes a marine riser string 24 that extends downwardly from the platform 20 to sea floor equipment that defines the entry point of the subsea well. In this manner, in some embodiments of the invention, the lower, subsea end of the marine rise string 24 connects to a blowout preventer (BOP) 30 that, in turn, is connected to a subsea well tree 31 (a horizontal well tree, for example). The subsea well tree 31, in turn, is connected to the well head 32 of the subsea well.

The marine riser string 24 provides protection from the surrounding sea environment for strings that are run through the string 24 from the platform 20 and into the subsea well. In this manner, the landing string 22 may be run through the marine riser string 24 for purposes of installing completion equipment, such as a tubing hanger and a production tubing, in the subsea well.

The landing string 22 includes a tool/module assembly 59 that is located at the lower remote end of the landing string 22. In the position shown in FIG. 1, the assembly 59 is located just above the BOP 30. As shown, the assembly 59 may have a slightly larger outer diameter than the rest of the landing string 22, and the outer diameter of the assembly 59 may approach the inner diameters of the BOP 30 and well tree 31. Therefore, either the running of the assembly 59 into the BOP 30 and/or well tree 31; or the retrieval of the assembly 59 from the BOP 30 and/or well tree 31 may be difficult due to the narrow clearances. As discussed below, features of the landing string 22 permit precise feedback and guidance of the lower end of the landing string 22 so that the assembly 59 may be guided through the BOP 30 and/or well tree 31 without becoming lodged in either member.

Figure 2:
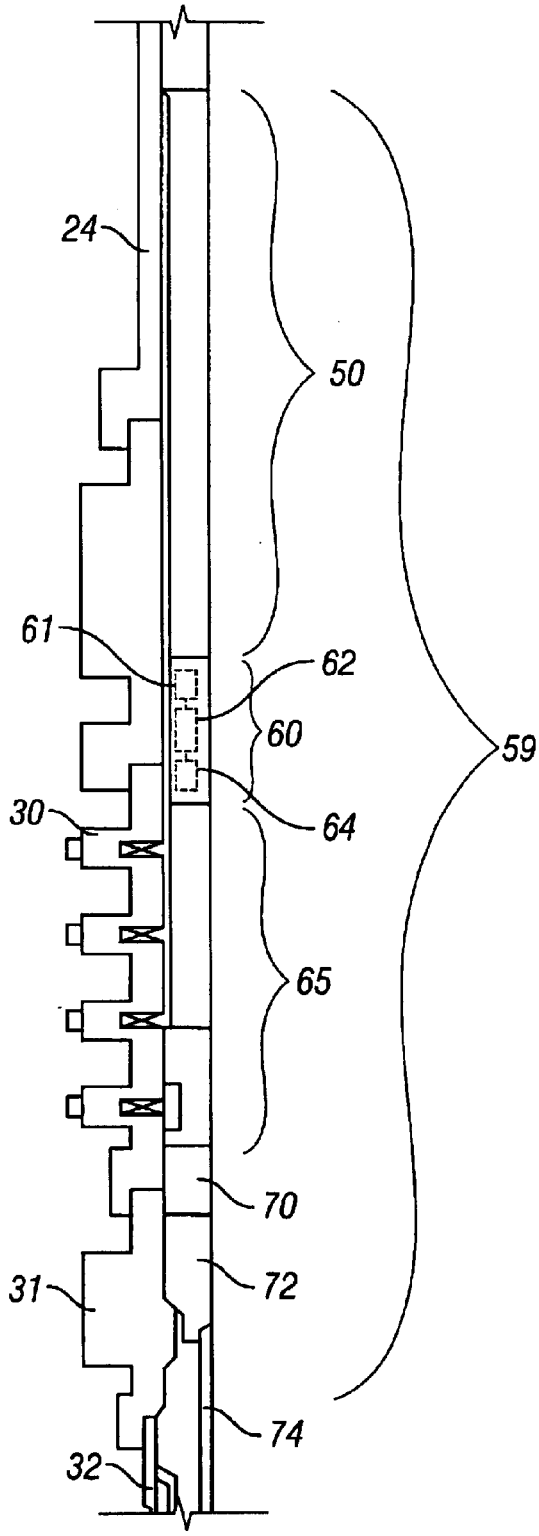
FIGS. 2, 4, 7 and 12 are schematic diagrams depicting a remote end segment of a landing string according to different embodiments of the invention.

FIG. 2 is an illustration of the subsea well equipment and the end of the landing string 22. It is noted that FIG. 2 and the following figures do not show full cross-sectional views of tubular members (such as a tubing hanger 72 and a well head 31), but rather, these figures show the left side cross-section. It is understood that the right side cross-section may be obtained by rotating the left side cross-section about the axis of symmetry.

Referring to FIG. 2, in some embodiments of the invention, the assembly 59 includes a tubing hanger running tool 70 that, as its name implies, is used to set a tubing hanger 72. The tubing hanger, in turn, resets in the well tree 31 and grips the well tree 31 when set by the tubing hanger running tool 70. A production tubing 74 is attached to (threaded into, for example) the tubing hanger 72 and extends below the tubing hanger 72, as depicted in FIG. 1.

Besides the tubing hanger running tool 70, the assembly 59 includes other tools that are related to the monitoring and management of the deployment of the completion equipment. For example, in some embodiments of the invention, the assembly 59 includes a module 50 that contains such tools as valves and a latch to control the connection and disconnection of the marine riser string 24 and landing string 22 to/from the BOP 30. In this manner, these tools provide potential emergency disconnection of the landing string 22 from the BOP 30, as well as prevent well fluid from flowing from the well or the landing string 22 during the disconnection and connection of the landing string 22 to/from the BOP 30. A more detailed example of the components (of the module 50) that are involved in the disconnection and connection of the landing string 22 and marine riser string 24 to the BOP 30 may be found in, for example, Nixon, U.S. Pat. No. 6,293,344, granted on Sep. 25, 2001.

The assembly 59 may include various other tools, such as a test module 65 (for example). As an example, the module may be used to perform pressure tests in the well.

Traditionally, using sensors that are located near the platform 20 to control and manage the deployment of completion equipment presents many challenges. For purposes of addressing these challenges, the landing string 22 has features that permit remote monitoring and managing of the deployment of the completion equipment. More specifically, in some embodiments of the invention, the assembly 59 of the landing string 22 includes a completion deployment management system module 60.

In some embodiments of the invention, the module 60 includes a sea communication telemetry circuit 61 that communicates (via an umbilical cord, for example) with the platform 20 for purposes of communicating indications of various parameters and conditions that are sensed by sensors 64 of the landing string 22. A variety of different subsea communication techniques may be used. As depicted in FIG. 2, the sensors 64 may be part of the module 60. However, as described herein, in some embodiments of the invention, the sensor 64 may be located in other parts of the landing string 22, as well as possibly being located in the well tree and other parts of the subsea well.

Regardless of the locations of the sensors 64, the sensors 64 are located near the remote, subsea end of the landing string 22. Thus, the sensors 64 provide electrical indications of various parameters and conditions, as sensed near the end of the landing string 22. This capability of being able to remotely sense these parameters and conditions, in turn, allows better monitoring and management of the deployment of subsea completion equipment.

Besides the sensors 64, in some embodiments of the invention, the module 60 may also include a processor 62 that communicates with the sensors 64 to obtain the various parameters and conditions that are indicated by these sensors 64. As described below, the processor may further process the information that is provided by one or more of the sensors 64 before interacting with the telemetry circuit 61 to communicate the processed information to the platform 20. The processor 62 interacts with the telemetry circuit 61 to communicate the various sensed parameters and conditions to the circuitry 21 at the platform 20.

Various types of sensors 64 are described below, each of which is associated with detecting or measuring a different condition or parameter that is present near the lower end of the landing string 22. A combination of the sensors 64 that are described herein may be used to achieve a more controlled landing of the tubing hanger 72 and a more precise operation of the tubing hanger running tool 70, as compared to conventional techniques.

Some of the sensors 64 may be located inside the module 60 for purposes of detecting various parameters and conditions that affect the running or retrieval of the tubing hanger 72. For example, one of the sensors 64 may be an accelerometer, a device that is used to provide an indication of the acceleration of the module 60 along a predefined axis. In this manner, one or more of these accelerometer sensors 64 may be used to provide electrical indications that the processor 62 uses to determine a vibration, for example, of the module 60. This vibration may be attributable to the interaction between the marine riser string 24 and the landing string 22 during the deployment or retrieval of the landing string 22. The telemetry circuitry 61, in turn, may communicate an indication of this detected vibration to the circuitry 21 on the platform 20. The vibration that is detected by the sensors 64 may be useful to, for example, measure the vibration during the running or the retrieval of the landing string 22 to ensure maximum running/retrieval speed without incurring damaging vibrations to the landing string 22.

Figure 3:
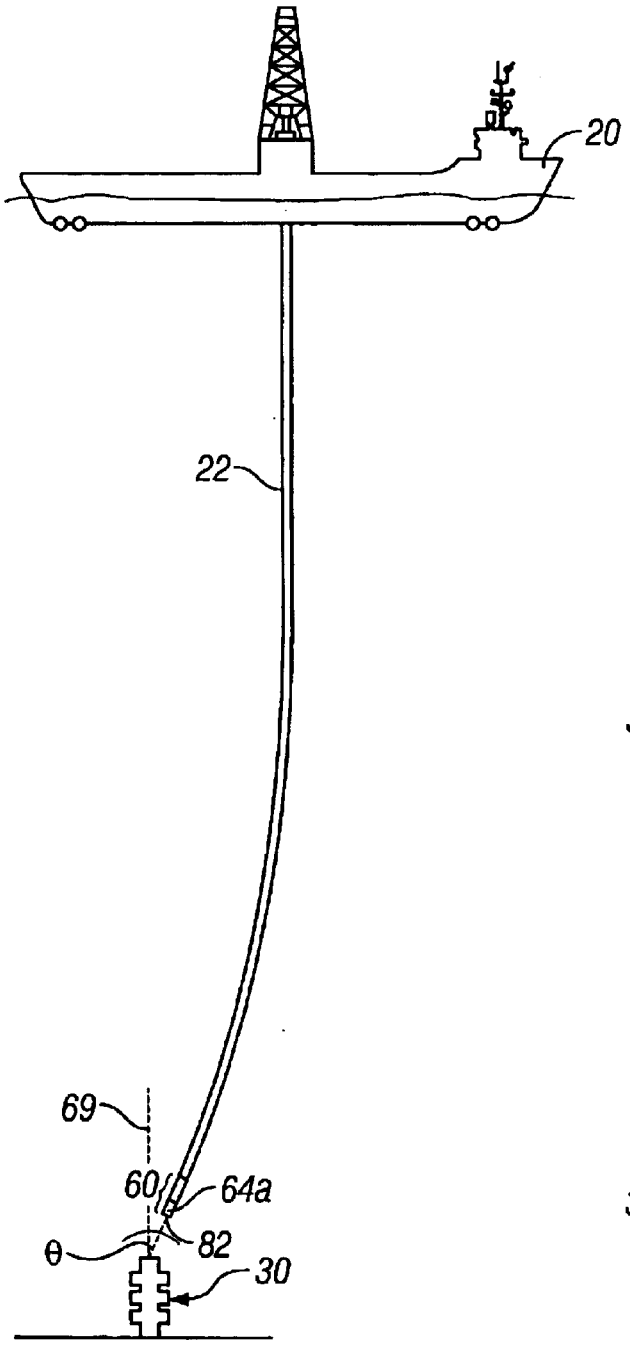
FIG. 3 is a schematic diagram of a subsea well system depicting deployment of the landing string according to an embodiment of the invention.

FIG. 3 depicts the deployment of the landing string 22, with the lower subsea end of the landing string 22 being located outside of the BOP 30. The marine riser string 24 is not depicted in FIG. 3 for purposes of clarity. In some embodiments of the invention, the sensors 64 may include an orientation sensor 64*a* that communicates an indication of the orientation of the module 60 (or the segment of the landing string 22 containing the module 60) to the processor 62 in relation to some subsea feature. For example, the sensor 64*a* may communicate an orientation of the module 60 with respect to the marine riser 24 (not depicted in FIG. 3), BOP 30 or well tree 31. This communication may occur in real time as the module 60 travels through the marine riser string 24 from the platform 20 to the subsea equipment and as the module 60 travels through the BOP 30 and well tree 31. As an example, in some embodiments of the invention, the orientation sensor 64*a* may be a gyroscope.

The orientation sensor 64*a* may, for example, communicate an indication of an azimuth, or angle (denoted by "θ") of inclination, between the module 60 and a reference axis 69 that extends along the central passageway of the subsea well tree 31 and BOP 30. In these embodiments of the invention, the orientation sensor 64*a* may be a gyroscope that provides an indication of the inclination of the module 60 or another part of the landing string 22 in which the orientation sensor 64*a* is located. Due to the potential small clearances that exist between the assembly 59 (FIG. 1) and the BOP 30/well tree 31, only a very small angle of inclination may be tolerated (i.e., an angle θ near zero degrees) to prevent the string 22 from becoming lodged inside the BOP 30/well tree 31. The knowledge of the angle θ also permits an operator at the surface platform 20 to determine whether the landing string 22 can be retrieved from the well without being stuck in the BOP 30/well tree 31. Thus, with the knowledge of the azimuth of the end of the landing string 22, the inclination of the string 22 may be adjusted before the landing string 22 is retrieved (or further retrieved) from the BOP 30/well tree 31 or inserted (or further inserted) into the BOP 30/well tree 31.

The orientation sensor 64*a* may sense additional orientation-related characteristics, such as, for example, the angular position of the lower end of the landing string 22 about the string's longitudinal axis. This angular position may be sensed near the lower end of the landing string 22. The measurement of the string's angular position may be desirable due to the inability to accurately determine the angular position of the lower end of the string 22 from a measurement of the angular position of the string 22 taken from a point near the platform 20. In this manner, due to the frictional forces that are exerted on the landing string 22, an angular displacement of the landing string 22 near at the surface platform 20 may produce a vastly different displacement near the subsea well. Thus, it is difficult if not impossible to detect the effect of a particular angular displacement at the platform 20 with respect to the resultant angular displacement at the subsea well. Thus, the orientation sensor 64*a* provides a more direct measurement for controlling the angular position of the landing string 22 inside the BOP and well tree 30. The knowledge of the angular position of the end of the landing string may be helpful to, for example, guide the landing string 22 as the end of the string rotates inside a helical groove inside the well tree 31.

Figure 4:
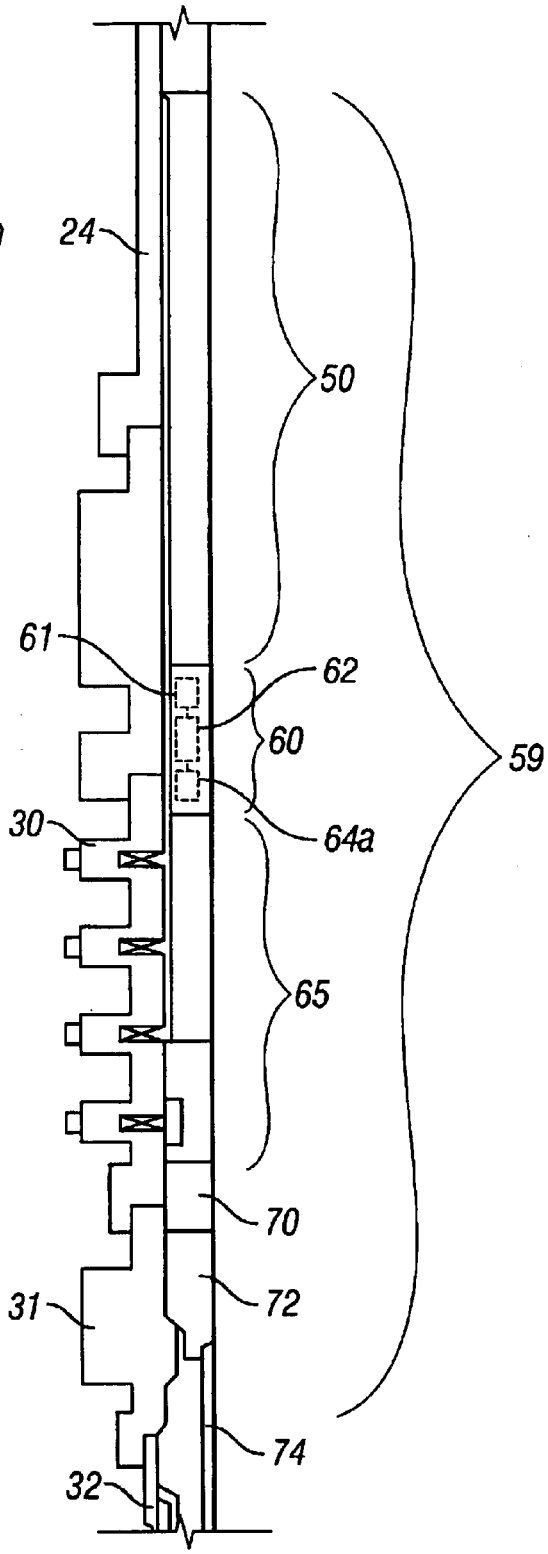

FIG. 4 depicts embodiments in which the orientation sensor 64*a* is located inside the completion module 60. However, in other embodiments of the invention, at least one orientation sensor 64*a* may be located closer to the tubing hanger 72, the point where the string 22 transitions to a larger diameter. Although one sensor 64*a* is depicted in FIG. 4, the landing string 22 may have additional orientation sensors 64*a*. For example, one of the sensors 64*a* may detect an inclination angle, another sensor 64*a* may detect an angular position, etc.

Figure 5:
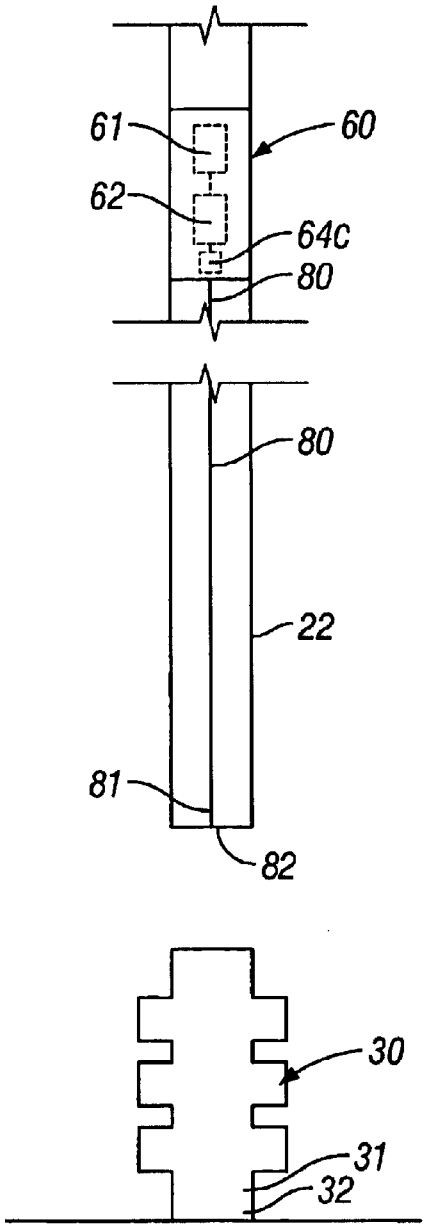
FIG. 5 is a schematic diagram of the landing string that includes a video camera sensor according to an embodiment of the invention.

Referring to FIG. 5, in some embodiments of the invention, the orientation of the landing string 22 near its end 82 may be sensed via a video camera sensor 64*c*. As an example, this video camera sensor 64*c* may be located inside the module 60. In this manner, the video camera sensor 64*c* forms frames of data that indicate captured images from near the end 82 of the landing string 22. The processor 62 and telemetry circuitry 61 communicate these frames of data to the circuitry 21 on the platform 20. In some embodiments of the invention, the video camera sensor 64*c* may be located inside the module 60, and a fiber optic cable 80 may be used to communicate an optical image that is taken near the end 82 to the video camera sensor 64*c*. In some embodiments of the invention, illumination lights and optics may be positioned near the end 82 to form the optical image that is communicated to the video camera sensor 64*c*.

Due to the use of the video camera sensor 64*c*, the orientation of the end 82 of the landing string 22 may be visually observed in real time from the platform 20. Thus, the video camera sensor 64*c* permits viewing of the landing area for the tubing hanger 72 as the tubing hanger 72 nears its final position. This visual feedback, in turn, permits close control of the position of the end of tubing hanger 72 during this time.

Figure 6:
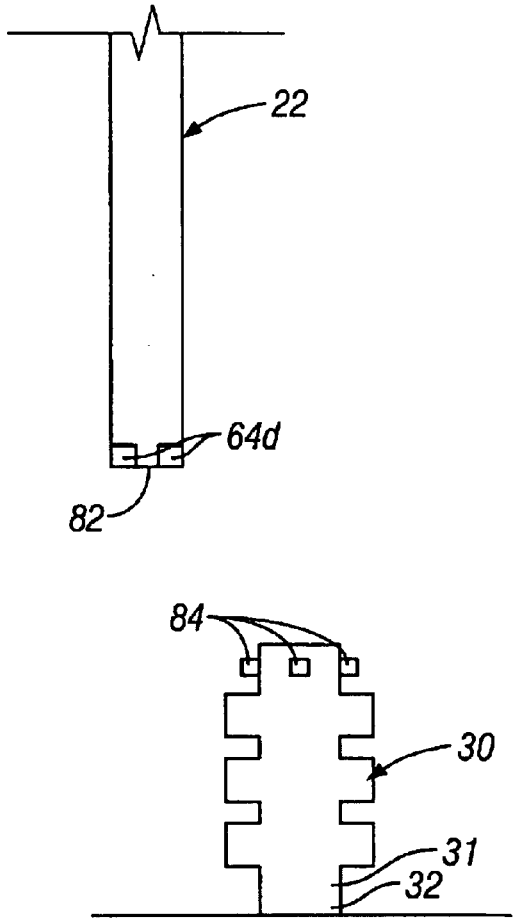
FIG. 6 is a schematic diagram of the landing string that includes laser sensors according to an embodiment of the invention.

Although it may be desirable to visually guide the tubing hanger 72 into place, the optical conditions near the end of the landing string 22 may be less than desirable. Therefore, in some embodiments of the invention, the landing string 22 may include other types of sensors that are located near the end 82 of the landing string 22 for purposes of sensing the position of the tubing hanger 72. Referring to FIG. 6, for example, in some embodiments of the invention, the sensors 64 may include a laser detecting sensor 64*d* that is positioned near the end 82, i.e., next to the tubing hanger 72. The marine riser string 24 is not depicted in FIG. 6 for purposes of clarity.

As depicted in FIG. 6, the laser detecting sensor 64*d* detects light that is emitted by one or more lasers 84 that are positioned inside or outside of the BOP 30, well tree 31 and/or well head 32. As an example, in some embodiments of the invention, the sensor 64*d* may be one of an array of laser sensors that sense light that is emitted from the laser(s) 84. Electrical signals from the laser sensors 64*d* are received by the processor 62 that uses a triangulation technique, for example, to derive the position of the tubing hanger 72 relative to the landing area of the well head. The processor 62 communicates an indication of this position to the circuitry 21 of the platform 20 via the telemetry circuitry 61.

Figure 7:
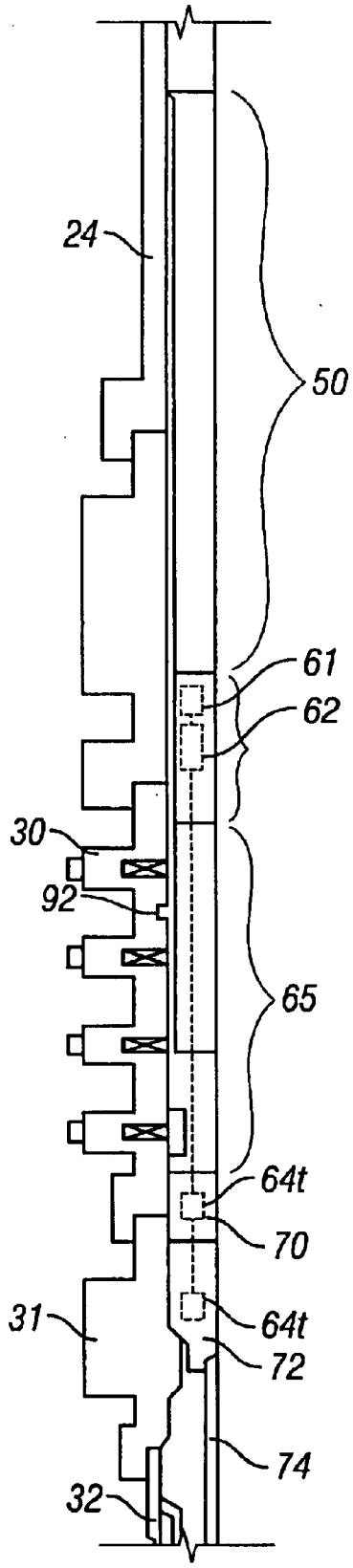

Referring to FIG. 7, in some embodiments of the invention, the sensors 64 may include at least one elevation sensor 64*t*, a sensor that detects the elevation of the tubing hanger 72 with respect to some other point, such as the platform 20, a point of the marine riser 24 (not depicted in FIG. 7), the BOP 30 or the well tree 31. During the final tubing hanger landout, the elevation sensors 64*t* measure the relationship between the tubing hanger position and the well tree 31 to ensure both that the tubing hanger 72 is positioned correctly and verify that there is no major obstruction between the tubing hanger 72 prior to activating locking dogs to lock the tubing hanger 72 in place to set the tubing hanger 72. Referring to FIG. 7, in some embodiments of the invention, the sensor (s) 64*t* are located in either the tubing hanger running tool 70 or the tubing hanger 72 to accomplish the above-described function.

As a more specific example, a particular elevation sensor 64*t* may be a video camera sensor that captures images surrounding the module 60, for example. In this manner, the video camera sensor may be used to monitor the BOP and/or well tree as the module 60 passes through for purposes of observing a particular cavity 92 (depicted in FIG. 7 as an example) of the BOP and/or well tree. By observing these cavities, the location of the tubing hanger 72 with respect to the well head may be ascertained.

Figure 8:
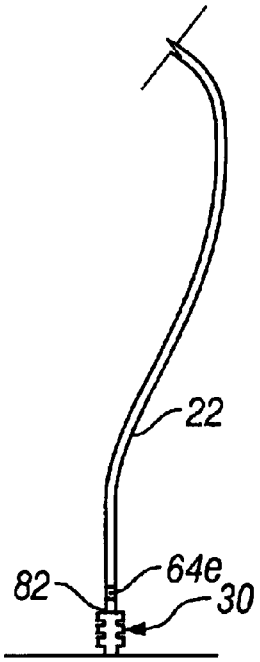
FIG. 8 is a schematic diagram of a landing string having a force detection sensor according to an embodiment of the invention.

Referring to FIG. 8, in some embodiments of the invention, the landing string 22 may include a sensor 64*e* to measure the tensile/compressive loading on the landing string 22 near the end 82 of the landing string 82. The marine riser string 24 is not depicted in FIG. 8 for purposes of clarity.

The sensor 64*e* is located near the end 82 of the landing string 22 to provide an indication of the hang off weight or compression on the string 22 or 24 to give real time feedback of events for purposes of landing the tubing hanger 72 or retrieving the landing string 22. The sensor 64*e* may include a strain gauge, for example, to allow determination of successful latching, landing and unlatching of the tubing hanger running tool 70. The sensor 64*e* may also provide an indication of the string tension, set down weights, tubing stretch, etc.

Due to the frictional forces that are exerted on the landing string 22, these indications of weight, compression, etc. that are provided by the sensor(s) 64*e* may not be obtainable from merely observing the forces on the string 22 near the platform 20. Therefore, the sensor(s) 64*e* provide more accurate indications of these actual forces near the end of the landing string 22.

Figure 9:
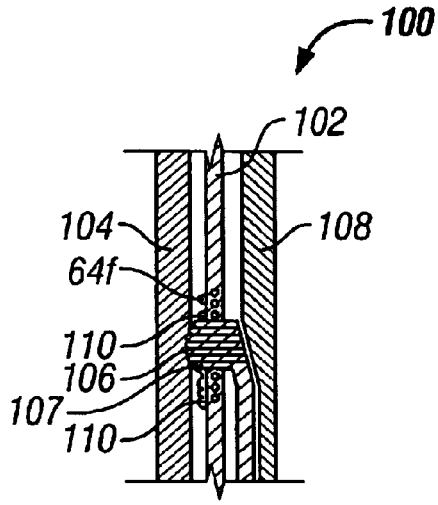
FIGS. 9 and 10 are schematic diagrams of arrangements to detect latching of a subsea well tool according to different embodiments of the invention.

Referring to FIG. 9, in some embodiments of the invention, the sensors 64 may include at least one sensor 64*f* that provides the status of a mechanical device that is located inside the landing string 22. For example, in some embodiments of the invention, the sensor 64*e* may provide the status of a locking dog 106 (see FIG. 9), a component of the tubing hanger 72. The locking dog 106 and other such dogs 106 (the other dogs 106 not depicted in FIG. 9) secure the tubing hanger 72 (a housing 102 and sleeve 108 of the tubing hanger 72 being depicted in FIG. 9) to a section 104 of the well tree 31. In this manner, as depicted in FIG. 9, in some embodiments of the invention, the sensor 64*e* may include a magnetic switch that includes coils 110 that extend around an opening 107 of the sleeve 108 through which the locking dog 106 extends. When the sleeve 108 pushes the locking dog 106 through the opening 107, the coils 110 of the sensor 64*f* may be used to sense (due to a change in the sensed permeability) that the dog 106 has been extended to latch onto the section 104.

Figure 10:
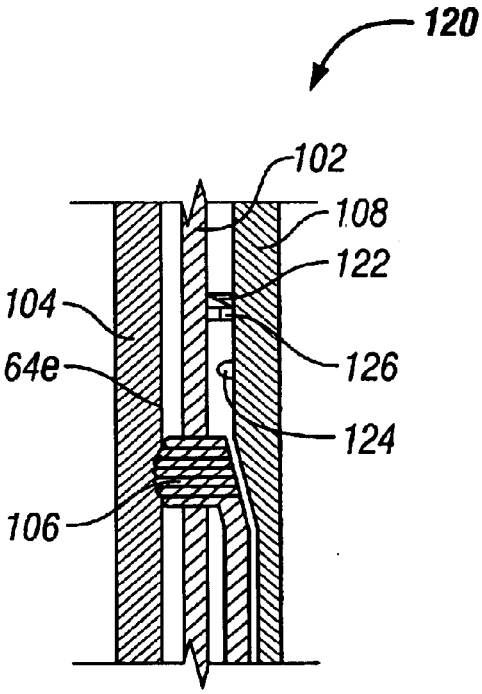

In other embodiments of the invention, the sensor 64*f* may include a mechanical switch 126 (FIG. 10) that senses when a particular sleeve has moved to a specified position. For example, as depicted in FIG. 10, the switch 126 may be activated, for example, in response to an annular member 122 of the sleeve 108 contacting a stationary annular member 124 when the dog 106 is moved into its locked position. Alternatively, the mechanical switch 126 may be replaced by, for example, a pressure sensor to determine a locking force of a particular downhole mechanism. Other variations are possible.

Figure 11:
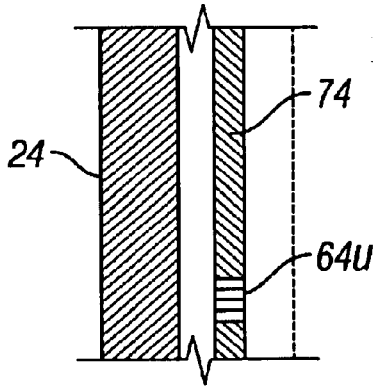
FIG. 11 is a schematic diagram of an arrangement to detect a torsion force on a subsea tubular according to an embodiment of the invention.

Referring to FIG. 11, in some embodiments of the invention, sensors 64 may be located in places other than the landing string 22. For example, in some embodiments of the invention, a sensor 64*u* may be located in the production tubing 74 for purposes of measuring the torsion on the production tubing 74 as the tubing 74 is run into the well bore. The sensor 64*u* is electrically coupled to the processor 62 for purposes of communicating indications of the sensed torsion to the circuitry 21 of the platform 20. Similar to the sensor 64*u*, in some embodiments of the invention, the landing string 22 may include a sensor (not shown) to sense torsion on the landing string 22. Other variations are possible.

Figure 12:
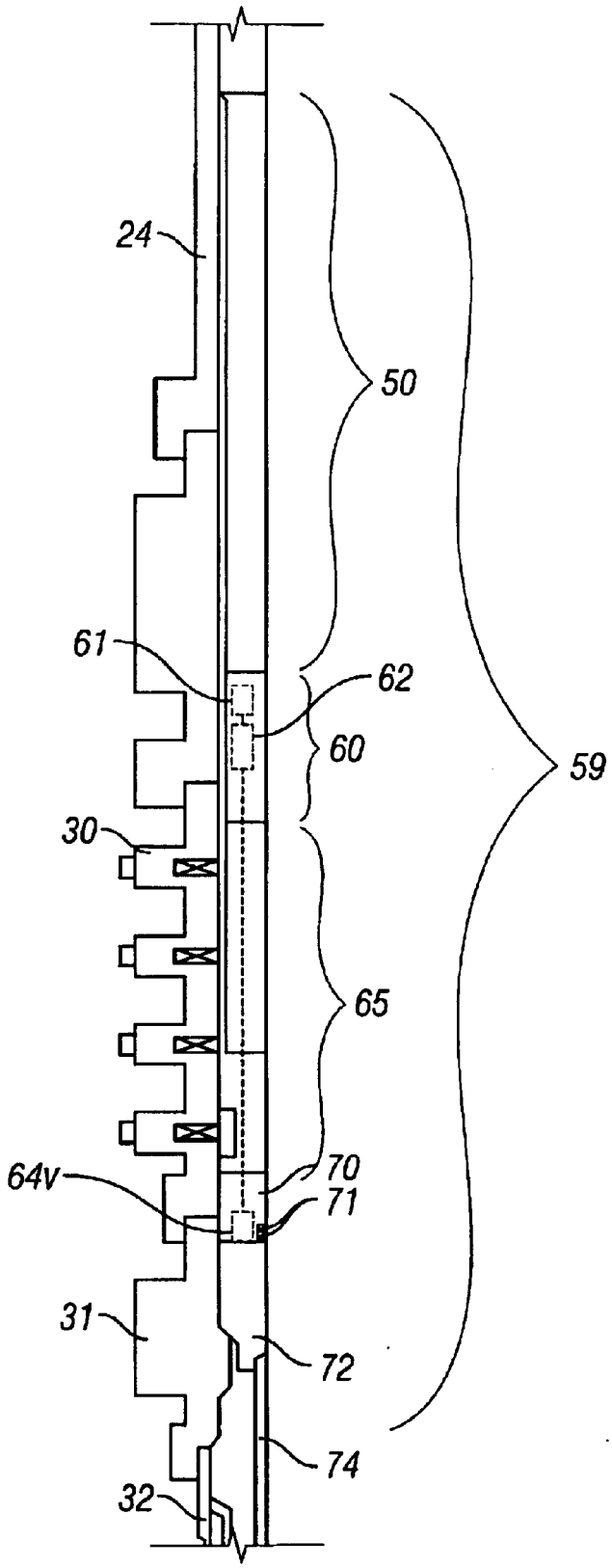

Referring to FIG. 12, in some embodiments of the invention, the sensor 64 may include a sensor 64*v* to check for debris on top of the tubing hanger 72 or internal tree cap prior to the landing of the tubular hanger 72. In this manner, the inclusion of flushing ports 71 in the tubing hanger running tool 70 permits the flushing of any debris should the debris be present on top of the internal tree cap or tubing hanger 72. As an example, the sensor 64*v* may be a video camera. Other sensors may be used.

Figure 13:
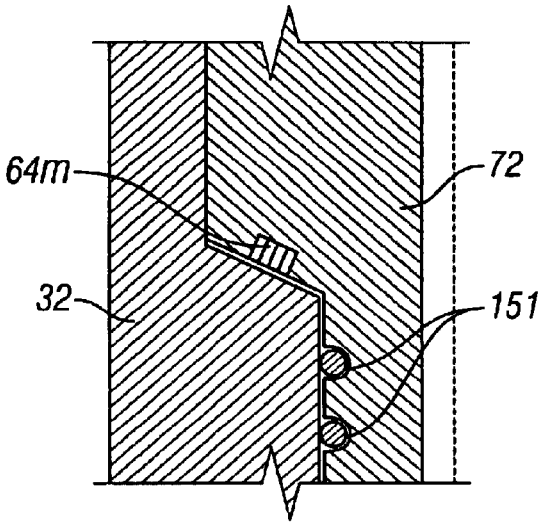
FIG. 13 is a schematic diagram of an arrangement to monitor a seal status according to an embodiment of the invention.

Referring to FIG. 13, in some embodiments of the invention, the sensors 64 may include sensors 64 that verify the correct setting of certain seals and the condition of these seals. For example, as depicted in FIG. 13, a particular pressure sensor 64*m* may be located in proximity to seals 151 that are located between the well tubing hanger 72 and head 32. The pressure sensor 64*m* may be located in the tubing hanger 72, for example. Using this arrangement, pressure tests may be initiated at the platform 20 to pressurize the sealed region below the seals 151. In this manner, the pressure sensor 64*m* may be used to verify that the seals 151 are seated properly in these pressure tests. Other types of sensors and placements for the sensors may be used to verify the setting and condition of a particular seal.

Figure 14:
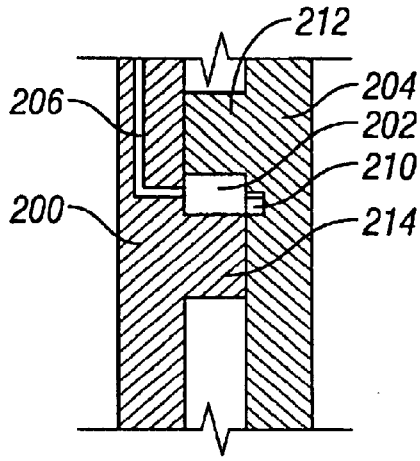
FIG. 14 is a schematic diagram of an arrangement to measure the condition of hydraulic fluid of a subsea control system according to an embodiment of the invention.

Referring to FIG. 14, in some embodiments of the invention, the sensors 64 may include one or more sensors 64*p* to monitor the condition of hydraulic fluid. For example, FIG. 14 depicts a chamber 202 that is created between an annular extension 212 of a housing 200 and an annular extension 214 of a sleeve 204. The sleeve 204 and housing 200 may be part of any tool of the string 22 and are depicted merely for purposes of illustrating use of the sensors 64*p*. The chamber 202 may be coupled to a passageway to other parts of the tool, and the sensor 64*p* may be a video camera sensor that is coupled to optics 210 and an illumination device 212 in the wall of the chamber 202. Alternatively, the sensor 64*p* may be an optical sensor or an acoustic sensor, as just a few examples. Regardless of the type of sensor, the sensor 64*p* provides an electrical indication of the condition of the hydraulic well fluid inside the chamber 202.

Figure 15:
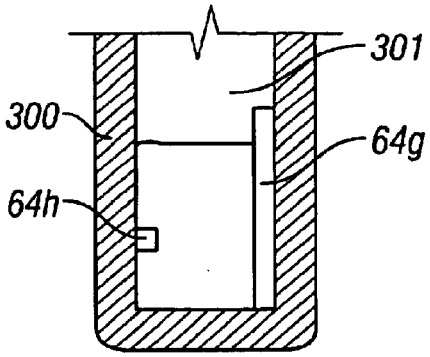
FIG. 15 is a schematic diagram of an arrangement to monitor fluid conditions in a subsea hydraulic accumulator according to an embodiment of the invention.

In some embodiments of the invention, the sensors 64 may include sensors to detect the condition of gas and volume/pressure inside hydraulic accumulators. For example, FIG. 15 depicts a chamber 301 that serves as a hydraulic accumulator. Thus, the chamber 301 includes hydraulic fluid. The sensors may include a pressure sensor 64*h* to provide an electrical indication of a pressure of the hydraulic fluid as well as a sensor 64*g* to measure the level of this fluid. As an example, the sensor 64*g* may be a resistivity sensor positioned such that the length of the sensor that is exposed to the hydraulic fluid is proportional to the level of the hydraulic fluid. Thus, the resistance that is sensed by the sensor 64*g* for this embodiment is also proportional to the level of the hydraulic fluid.

Figure 16:
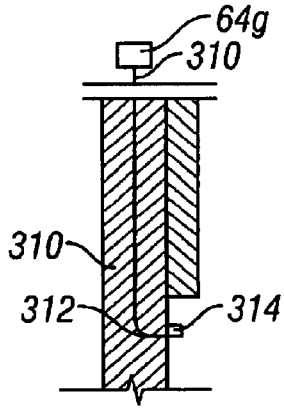
FIG. 16 is a schematic diagram of an arrangement to view the position of a moving component inside a subsea landing string according to an embodiment of the invention.

Referring to FIG. 16, in some embodiments of the invention, the sensors may include a sensor 64*q* to provide an image of the position of particular moving component of the landing string 22, such as a ball valve, actuation sleeve, locking system, etc. of the string 22. In this manner, the sensor 64*q* may be a video camera sensor that is linked (via a fiber optic cable 310) to optics 312 and an illumination device 314 that are positioned near the particular moving component. The sensor 64*q* communicates images of the moving component to the processor 62 and telemetry circuitry 61 that, in turn, communicate electrical indications of these images to the platform 20. Alternatively, the sensor 64*q* may be, for example, a magnetic resonance imaging (MRI) sensor that provides electrical indications of an image produced through an MRI scan of a selected portion of the string 22. Other variations are possible.

Figure 17:
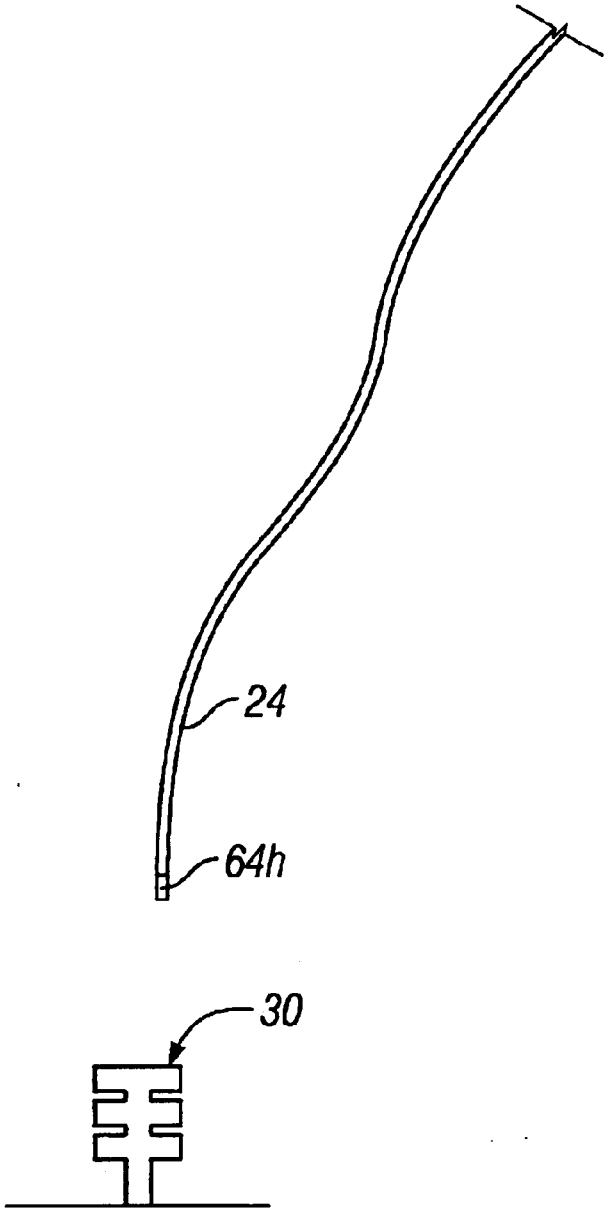
FIG. 17 is a schematic diagram of a system to sense the proximity of a subsea land out interface according to an embodiment of the invention.

Referring to FIG. 17, in some embodiments of the invention, the sensors may include a sensor 64*h* that is located at the end of the tubing hanger running tool to provide indication of the proximity of a landout interface for a particular component. The marine riser 24 is not depicted in FIG. 17 for purposes of clarity. As an example, the sensor 64*h* may be an acoustic sensor. As a more specific example, the sensor 64*h* may be a sonar antenna to provide an acoustic image of the tubing hanger landing area in the well tree 31 so that proximity to the landing out of the tubing hanger 72 on the well head may be ascertained. For this embodiment, active sonar may be used and the string 22 may include a sonar transmitter.

Figure 18:
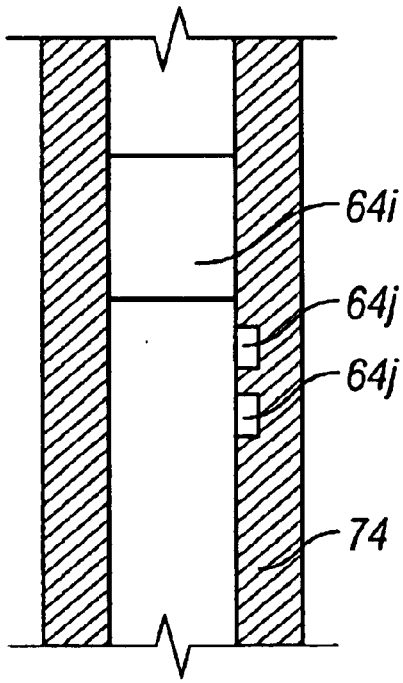
FIG. 18 is a schematic diagram of a sensor to monitor hydrate and wax management according to an embodiment of the invention.

Referring to FIG. 18, in some embodiments of the invention, the sensors may include various sensors to detect the possibility of hydrate or wax buildup downhole. In this manner, the sensors may include a sensor 64*i* that is located in the central passageway of the production tubing 74 to measure the flow of a particular fluid as well as other sensors 64*j* that measure various chemical and other properties downhole that typically accompany or precede hydrate or wax buildup. For example, the sensors 64*j* may include a temperature sensor, as the temperature is a key factor in the formation of wax deposits and hydrate formations. As another example, the sensors 64*j* may include deposition sensors, sensors that indicate the buildup of, for example, scale (calcium carbonates etc), ashphaltenes, etc.

Figure 19:
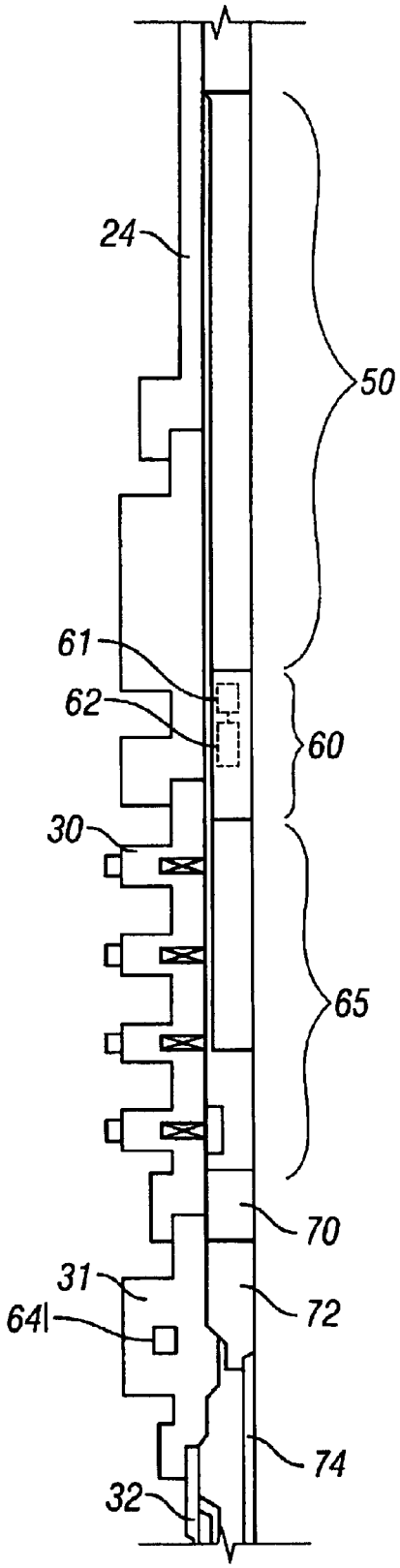
FIG. 19 is a schematic diagram of an arrangement to monitor chemical injection into the subsea well according to an embodiment of the invention.

A sensor 64*l* (FIG. 19) may be located in the well tree 31 for purposes of monitoring the flow rate of a particular injected chemical that is introduced into the well at the well tree 31. Other variations are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a subsea well and subsea equipment capable of landing out in the well, the system comprising:

a tubular string extending from a surface platform toward a sea floor and adapted to extend into the well below the sea floor, the string having an upper end and a lower remote end; and at least one sensor being part of the string and located near the remote end of the string to monitor deployment of subsea equipment into the subsea well at least before the subsea equipment lands out in the subsea well.

2. The system of claim 1, wherein the subsea equipment comprises a tubing hanger.

3. The system of claim 1, wherein the subsea equipment comprises a production tubing.

4. The system of claim 1, wherein said at least one sensor comprises a sensor selected from the group consisting of:

a pressure sensor, an acoustic sensor, a video camera sensor, a resistivity sensor, a gyroscope, an accelerometer, a strain gauge, a mechanical switch and a magnetic switch.

5. The system of claim 1, wherein said at least one switch comprises a sensor to indicate an orientation of the tubular string near the remote end.

6. The system of claim 5, wherein the orientation sensor indicates an azimuth of the tubular string near the remote end.

7. The system of claim 5, wherein the sensor to indicate an orientation indicates a rotational position of the tubular string near the remote end.

8. The system of claim 5, wherein the sensor to indicate an orientation comprises a sensor selected from the group consisting of:

a video camera sensor, a laser sensor and a gyroscope.

9. The system of claim 1, wherein said at least one sensor comprises:

an elevation sensor to indicate an elevation of the tubular string near the remote end of the tubular string.

10. The system of claim 9, wherein the elevation sensor comprises a video camera sensor.

11. The system of claim 1, wherein a sensor of said at least one sensor indicates a force on the tubular string.

12. The system of claim 11, wherein the force comprises at least one of a compressive loading force and a tensile loading force.

13. The system of claim 11, wherein the tubular string comprises at least one of the following:

a production tubing and a landing string.

14. The system of claim 1, wherein a sensor of said at least one sensor provides a status of a locking force on a component of the tubular string.

15. The system of claim 14, wherein the component comprises a dog of a tubing hanger.

16. The system of claim 14, wherein the sensor to provide the status of the locking force comprises at least one of the following:

a mechanical switch, a magnetic switch and a pressure sensor.

17. The system of claim 1, wherein a sensor of said at least one sensor indicates vibration on the tubular string near the remote end of the tubular string.

18. The system of claim 17, wherein the sensor that indicates vibration comprises:

an accelerometer.

19. The system of claim 1, wherein a sensor of said at least one sensor provides an indication of the existence of debris on a tubing hanger or a well cap of the subsea well.

20. The system of claim 19, wherein the sensor to provide the indication of the existence of debris comprises a video camera sensor.

21. The system of claim 1, wherein a sensor of said at least one sensor provides an indication of a condition of control fluid in the tubular string.

22. The system of claim 21, wherein the sensor to provide an indication of the condition of the control fluid comprises at least one of the following:

an acoustic sensor and an optical sensor.

23. The system of claim 1, wherein a sensor of said at least one of sensor indicates a condition of fluid in the tubular string.

24. The system of claim 23, wherein the condition comprises at least one of the following:

a volume and a pressure.

25. The system of claim 1, wherein a sensor of said at least one of sensor indicates proximity of the remote end of the tubular string to landing out on submersible equipment of the subsea well.

26. The system of claim 25, further comprising:

a tubing hanger, wherein the sensor that indicates proximity of the end of the tubular string to landing out indicates proximity to the tubing hanger landing out on a well head of the subsea well.

27. The system of claim 1, wherein a sensor of said at least one of sensor indicates a status of a seal of the tubular string.

28. The system of claim 27, wherein the sensor that indicates the status of the seal comprises a pressure sensor.

29. The system of claim 1, wherein a sensor of said at least one sensor indicates a position of a moving part of a component of the tubular string.

30. The system of claim 29, wherein the sensor that indicates the position of the moving part comprises a video camera sensor.

31. The system of claim 29, wherein the component comprises at least one of the following:

a valve, a sleeve and a locking system.

32. The system of claim 1, wherein a sensor of said at least one sensor indicates onset of hydrate or wax buildup in the subsea well.

33. The system of claim 32, wherein the sensor to indicate the onset of hydrate or wax buildup comprises at least one of the following:

a pressure sensor and a flow sensor.

34. The system of claim 1, wherein a sensor of said at least one sensor indicates a chemical flow into the subsea well.

35. The system of claim 1, further comprising:

a telemetry circuit to communicate an indication from said at least one sensor to the platform.

36. The system of claim 1, further comprising:

a processor to process at least one indication from said at least one sensor and communicate the processed said at least one indication to the platform.

37. A method usable with a subsea well and a tubular string capable of landing out in the well, the method comprising:

extending the tubular string from a surface platform toward a sea floor, the string having an upper end and a lower remote end;

extending the tubular string into the subsea well beneath the sea floor; and positioning at least one sensor in the string near the remote end of the string to monitor deployment of subsea equipment at least before the tubular string lands out in the subsea well.

38. The method of claim 37, wherein the subsea equipment comprises a tubing hanger.

39. The method of claim 37, wherein the subsea equipment comprises a production tubing.

40. The method of claim 38, wherein said at least one sensor comprises a sensor selected from the group consisting of:

a pressure sensor, an acoustic sensor, a video camera sensor, a resistivity sensor, a gyroscope, an accelerometer, a strain gauge, a mechanical switch and a magnetic switch.

41. The method of claim 37, wherein said least one switch comprises a sensor to indicate an orientation of the tubular string near the remote end.

42. The method of claim 41, wherein the sensor to indicate an orientation indicates an azimuth of the tubular string near the remote end.

43. The method of claim 41, wherein the orientation sensor to indicate an orientation indicate a rotational position of the tubular string near the remote end.

44. The method of claim 41, wherein the sensor to indicate an orientation comprises a sensor selected from the group consisting of:

a video camera sensor, a laser sensor and a gyroscope.

45. The method of claim 37, wherein said at least one sensor comprises:

an elevation sensor to indicate an elevation of the tubular string near the remote end of the tubular string.

46. The method of claim 45, wherein the elevation sensor comprises a video camera sensor.

47. The method of claim 37, wherein a sensor of said at least one sensor indicates a force on the tubular string.

48. The method of claim 47, wherein the force comprises at least one of a compressive loading force and a tensile loading force.

49. The method of claim 47, wherein the tubular string comprises at least one of:

a production tubing and a landing string.

50. The method of claim 37, wherein a sensor of said at least one sensor provides a status of a locking force on a component of the tubular string.

51. The method of claim 50, wherein the component comprises a dog of tubing hanger.

52. The method of claim 50, wherein the sensor to provide the status of the locking force comprises at least one of the following:

a mechanical switch, a magnetic switch and a pressure sensor.

53. The method of claim 37, wherein a sensor of said at least one sensor indicates vibration on the tubular string near the remote end of the tubular string.

54. The method of claim 53, wherein the sensor comprises an accelerometer.

55. The method of claim 37, wherein a sensor of said at least one sensor provides an indication of an existence of debris on a tubing hanger or a well cap of the subsea well.

56. The method of claim 55, wherein the sensor to provide the indication of the existence of debris comprises a video camera sensor.

57. The method of claim 37, wherein a sensor of said at least one of the sensor provides an indication of a condition of control fluid in the tubular string.

58. The method of claim 57, wherein the sensor to provide an indication of the condition of the control fluid comprises at least one of the following:

an acoustic sensor and an optical sensor.

59. The method of claim 37, wherein a sensor of said at least one sensor indicates a condition of fluid in the tubular string.

60. The method of claim 59, wherein the condition comprises at least one of the following:

volume and pressure.

61. The method of claim 56, wherein a sensor of said at least one sensor indicates proximity of the remote end of the tubular string to landing out on submersible equipment of the subsea well.

62. The method of claim 61, wherein the sensor that indicates proximity of the end of the tubular string to landing out indicates proximity to a tubing hanger landing out on a well head of the subsea well.

63. The method of claim 37, wherein a sensor of said at least one of sensor indicates a status of a seal of the tubular string.

64. The method of claim 63, wherein the sensor that indicates the status of the seal comprises a pressure sensor.

65. The method of claim 37, wherein a sensor of said at least one sensor indicates a position of a moving part of a component of the tubular string.

66. The method of claim 65, wherein the sensor that indicates the position of the moving part comprises a video camera sensor.

67. The method of claim 65, wherein the component comprises at least one of the following:

a valve, a sleeve and a locking system.

68. The method of claim 37, wherein a sensor of said at least one sensor indicates onset of hydrate or wax buildup in the subsea well.

69. The method of claim 68, wherein the sensor to indicate the onset of hydrate or wax buildup comprises at least one of the following:

a pressure sensor and a flow sensor.

70. The method of claim 37, wherein a sensor of said at least one sensor comprises a sensor to indicate a chemical flow into the subsea well.

71. The method of claim 37, further comprising:

communicating an indication from said at least one sensor to the platform.

72. The method of claim 37, further comprising:

processing at least one indication from said at least one sensor and communicating the at least one processed indication to the platform.

73. A system usable with a subsea well comprising:

a tubular string extending from a surface platform toward a sea floor, the string having an upper end and a lower remote end;

at least one sensor located near the remote end of the string to monitor deployment of subsea equipment into the subsea well;

a tubing hanger running tool; and a tubing hanger set by the tubing hanger running tool, wherein a sensor of said at least one sensor is located in the tubing hanger running tool.

74. The system of claim 73, wherein said at least one sensor comprises a sensor selected from the group consisting of:

a pressure sensor, an acoustic sensor, a video camera sensor, a resistivity sensor, a gyroscope, an accelerometer, a strain gauge, a mechanical switch and a magnetic switch.

75. The system of claim 73, wherein said at least one switch comprises a sensor to indicate an orientation of the tubular string near the remote end.

76. The system of claim 73, wherein said at least one sensor comprises:

an elevation sensor to indicate an elevation of the tubular string near the remote end of the tubular string.

77. The system of claim 73, wherein a sensor of said at least one sensor provides an indication of the existence of debris on a tubing hanger or a well cap of the subsea well.

78. The system of claim 73, further comprising:

a telemetry circuit to communicate an indication from said at least one sensor to the platform.

79. A method usable with a subsea well comprising:

extending a tubular string from a surface platform toward a sea floor, the string having an upper end and a lower remote end; and positioning at least one sensor near the remote end of the string to monitor deployment of subsea equipment, wherein the positioning comprises positioning at least one sensor of said at least one sensor in a tubing hanger running tool.

80. The method of claim 79, wherein said at least one sensor comprises a sensor selected from the group consisting of:

a pressure sensor, an acoustic sensor, a video camera sensor, a resistivity sensor, a gyroscope, an accelerometer, a strain gauge, a mechanical switch and a magnetic switch.

81. The method of claim 79, wherein said least one switch comprises a sensor to indicate an orientation of the tubular string near the remote end.

82. The method of claim 79, wherein said at least one sensor comprises:

an elevation sensor to indicate an elevation of the tubular string near the remote end of the tubular string.

83. The method of claim 79, further comprising:

using circuitry to communicate an indication from said at least one sensor to the surface platform.

* * * * *